United States Patent [19]

Fisher et al.

[11] 4,413,398

[45] Nov. 8, 1983

[54] SLIDE FASTENER CHAIN WITH LEG REMANENTS AT GAP AND METHOD AND APPARATUS OF MANUFACTURE

[75] Inventors: Harry M. Fisher, Whitestone; Stuart N. Fisher, Floral Park, both of N.Y.

[73] Assignee: Talon, Inc., Meadville, Pa.

[21] Appl. No.: 304,450

[22] Filed: Sep. 21, 1981

[51] Int. Cl.[3] ..... B21D 53/54; A41H 37/06

[52] U.S. Cl. ..... 29/410; 29/766; 29/770

[58] Field of Search ..... 29/408, 409, 410, 766, 29/770; 83/921

[56] References Cited

U.S. PATENT DOCUMENTS

| | | | |
|---|---|---|---|
| 3,812,573 | 5/1974 | Fukuroi | 29/410 |
| 3,958,319 | 5/1976 | Takamatsu | 29/410 |
| 4,332,072 | 6/1982 | Isella | 29/410 |

*Primary Examiner*—Francis S. Husar
*Assistant Examiner*—Steven E. Nichols
*Attorney, Agent, or Firm*—Anthony A. O'Brien

[57] ABSTRACT

Gaps in molded polymer fastening elements secured to inner edge portions of coplanar support tapes are formed by cutting legs of the coupling elements in planes coplanar with the inner edge portions of the support tapes leaving remanents of the molded polymer attached to the tapes along the gap.

10 Claims, 23 Drawing Figures

FIG. 7
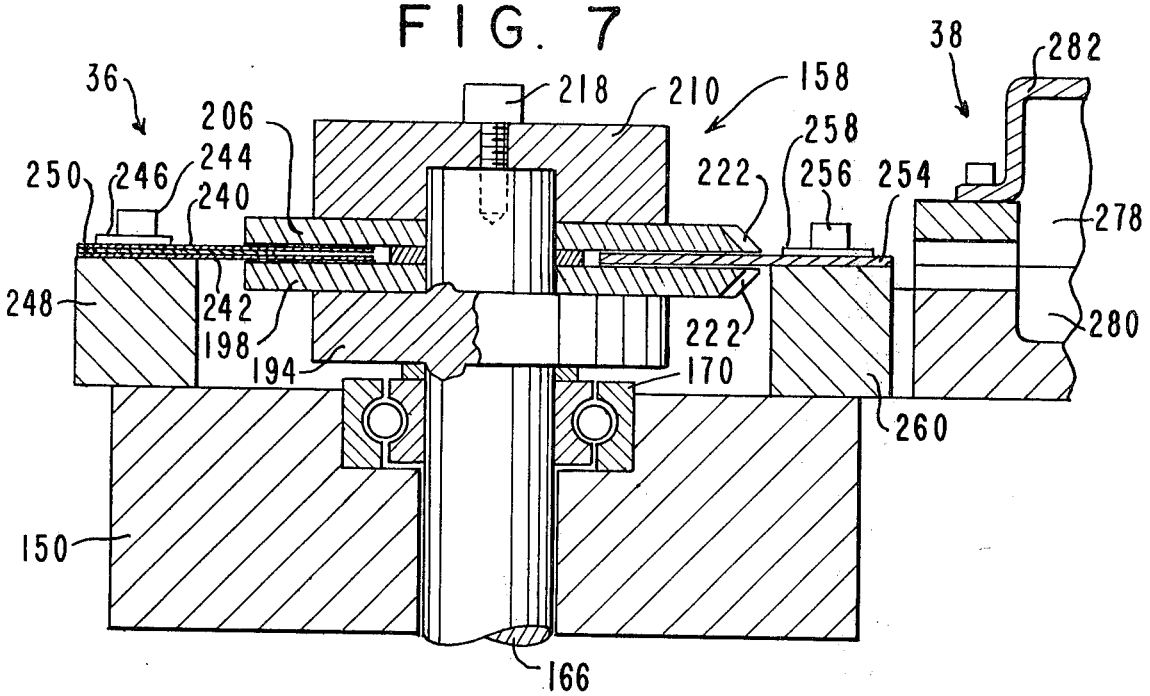
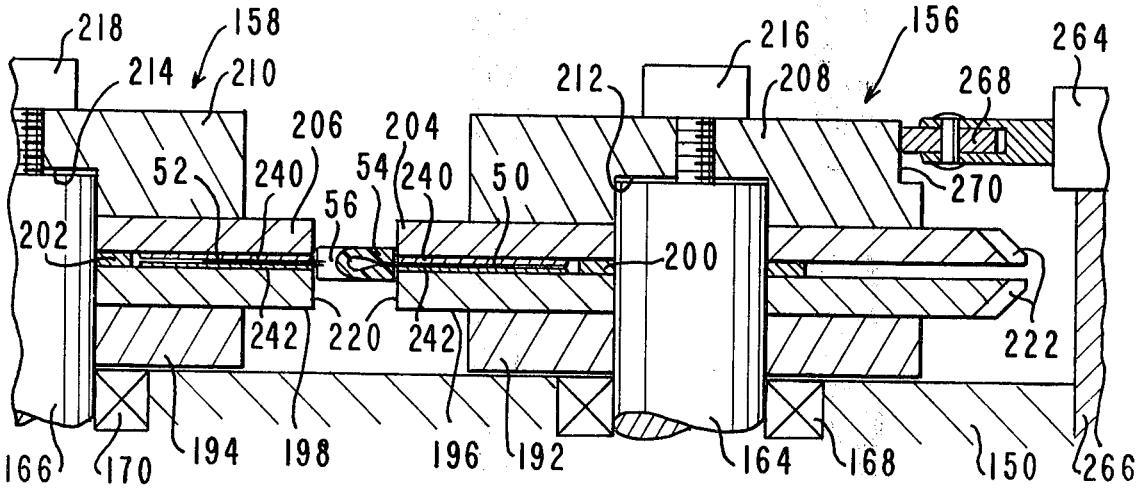
FIG. 8
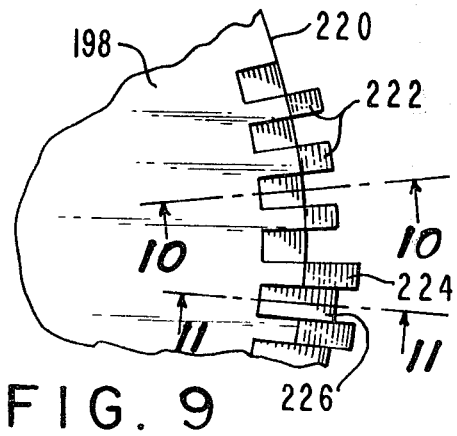
FIG. 9
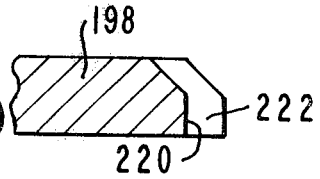
FIG. 10
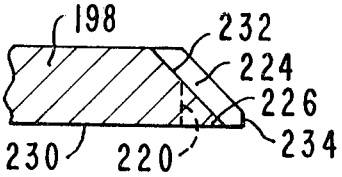
FIG. 11

FIG. 19
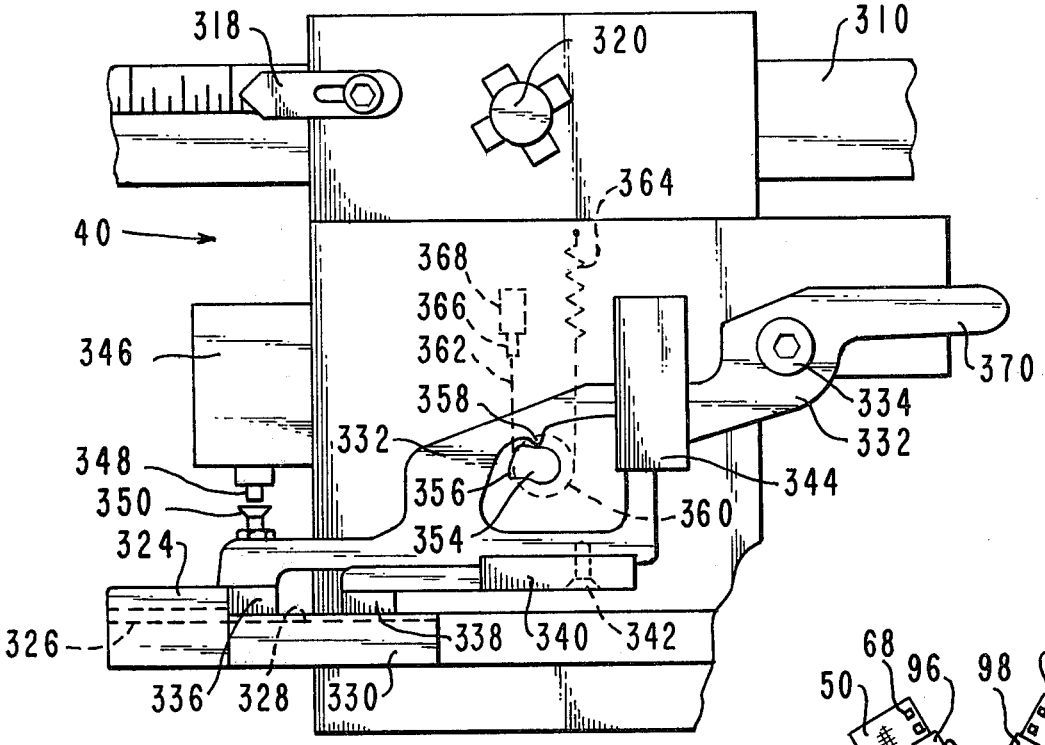
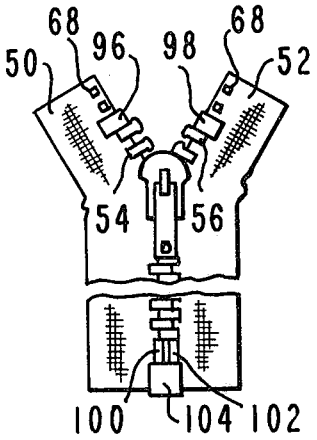
FIG. 20
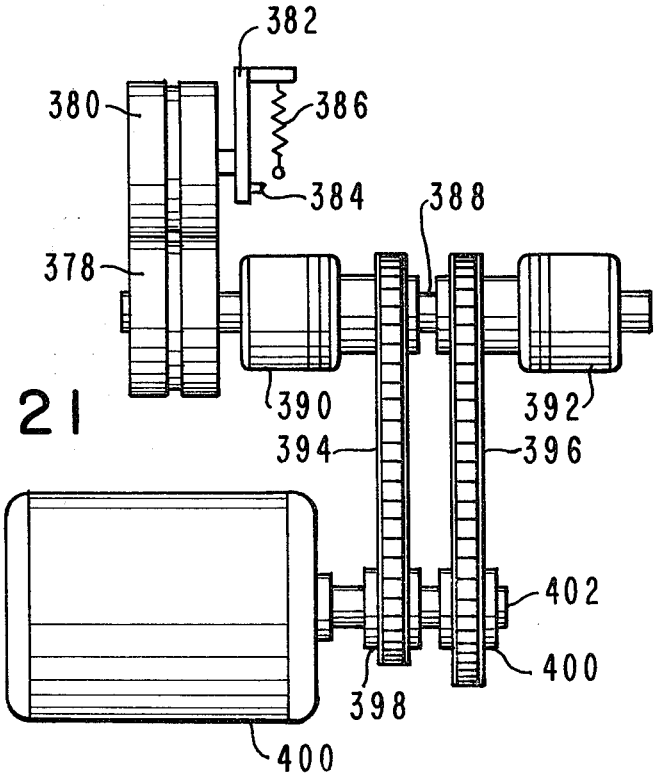
FIG. 21
FIG. 22
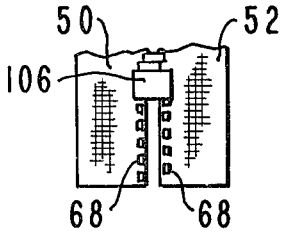

SLIDE FASTENER CHAIN WITH LEG REMANENTS AT GAP AND METHOD AND APPARATUS OF MANUFACTURE

TECHNICAL FIELD

The invention relates to slide fasteners and methods and apparatus of manufacture wherein a group of interlocking coupling elements or portions thereof have been removed from inner edges portions of their supporting tapes to form a gap.

BACKGROUND ART

Prior art slide fasteners having coupling elements molded on connecting threads which are woven into inner edges of supporting tapes have gaps formed in the coupling element trains by (1) severing only the head portions of the coupling elements and leaving the leg portions attached to the tapes as illustrated in U.S. Pat. No. 4,238,871 or (2) cutting the connecting members between the elements and pulling the elements with the severed stubs of connecting elements from the edge of the tape as illustrated for example in U.S. Pat. Nos. 4,241,489 and 4,274,191. At the gaps in the slide fasteners formed by severing and removing only the head portions, the remaining protruding leg portions are difficult to sew through and can be abrasive to clothing, skin, etc. In the slide fasteners having gaps formed by removing the connecting threads with the elements, the inner edges of the tapes have relatively loose loops of weft threads due to the removal of the connecting threads; these loose edges generally do not provide adequate support for top stops, bottom stops, pin members, or retainers employed in different types of slide fasteners.

In prior art slide fasteners wherein polymer coupling elements are molded directly onto the edges of supporting tapes, the elements are removed by pulling them from the edge of the tape as illustrated in U.S. Pat. No. 4,091,532 or severing the head portions as disclosed in U.S. Pat. No. 3,831,474 and removing the remaining legs from the tapes. In these processes, damage can occur to the tapes and/or protruding portions can be left on the tapes.

Additionally the prior art, as exemplified in the U.S. Pat. Nos. 2,594,789, 3,711,930, 3,540,090, 3,611,545 and 4,131,223 contains slide fasteners as well as processes and apparatus for gapping slide fasteners employing element trains which are crimped or sewn to the edges of the tapes. In the above mentioned U.S. Pat. No. 2,594,789, legs of a slide fastener element are cut or stripped from the opposite sides of the tape by prongs of a scoop removal pliers, the head of the element being pushed by a plunger driven by the pliers to force the element onto the prongs which have outer inclined diverging surfaces for spreading the legs of the element to disconnect the element from the tape. In the above mentioned U.S. Pat. Nos. 3,540,090, 3,611,545 and 3,711,930, severing the sewing threads between coil elements and tapes by cutting members is illustrated. Generally the processes and apparatus for removing crimped metal coupling elements and sewn elements from tapes are not usable in processes for gapping elements which are molded directly onto edges of the tapes or onto connecting threads woven into edges of the tapes.

SUMMARY OF THE INVENTION

The invention is summarized in a slide fastener chain including a pair of coplanar supporting tapes having respective inner longitudinal edge portions, a pair of rows of spaced molded polymer interlocking coupling elements each coupling element having a head and a pair of legs extending from the head, the legs being secured to first sections of the respective inner longitudinal edge portions of the tapes, a pair of rows of spaced pairs of remanents of severed legs of removed coupling elements secured to second sections of the respective inner longitudinal edge portions of the tapes, the legs of the coupling elements protruding substantial distances from respective opposite surfaces of the inner edge portions of the tapes for being engaged by a slider, and the remanents having outer surfaces extending generally parallel to the tapes and generally coplanar with the respect opposite surfaces of the inner edge portions of the tapes.

An object of the invention is to provide a slide fastener with a gap in fastening elements molded onto connecting threads or directly onto the edges of supporting tapes wherein the tape edges at the gapped section include remanents of molded leg portions for reinforcing the tape edges.

Another object of the invention is to eliminate abrasion caused by protruding leg portions.

It is also an object of the invention to render sewing across gapped sections easier by eliminating substantial protruding leg portions on tape edges.

One advantage of the invention is that tape edges in the gapped portion retain their stiffness even though the protruding portions of the coupling elements have been removed therefrom.

One feature of the invention is that a reinforced firm base is provided on gapped tape edges for supporting stops, pin members, retainers, or the like.

Other objects advantages, and features of the invention will be apparent from the following description of the prefered embodiment taken in conjunction with the accompanying drawings.

BRIEF DESCRIPTION OF THE DRAWINGS

FIG. 7 is a section view taken along line 7—7 of FIG. 6.

FIG. 8 is a section view taken along line 8—8 of FIG. 6.

FIG. 9 is a enlarged bottom view of a broken away portion of one cutting wheel of the apparatus shown in FIG. 6.

FIG. 10 is a section view taken along line 10 of FIG. 9.

FIG. 11 is a section view taken along line 11—11 of FIG. 9.

FIG. 19 is a front elevation view of a gap detecting mechanism in the apparatus of FIGS. 1 and 2.

FIG. 20 is a plan view of a slide fastener, with a portion broken away, manufactured in accordance with the invention.

FIG. 21 is a diagramatical elevational view of a two speed driving arrangement for a pulling mechanism in the apparatus of FIGS. 1 and 2.

FIG. 22 is a plan view of a broken-away portion of an alternative slide fastener constructed in accordance with the invention.

DESCRIPTION OF THE PREFERRED EMBODIMENT

Figure 1:
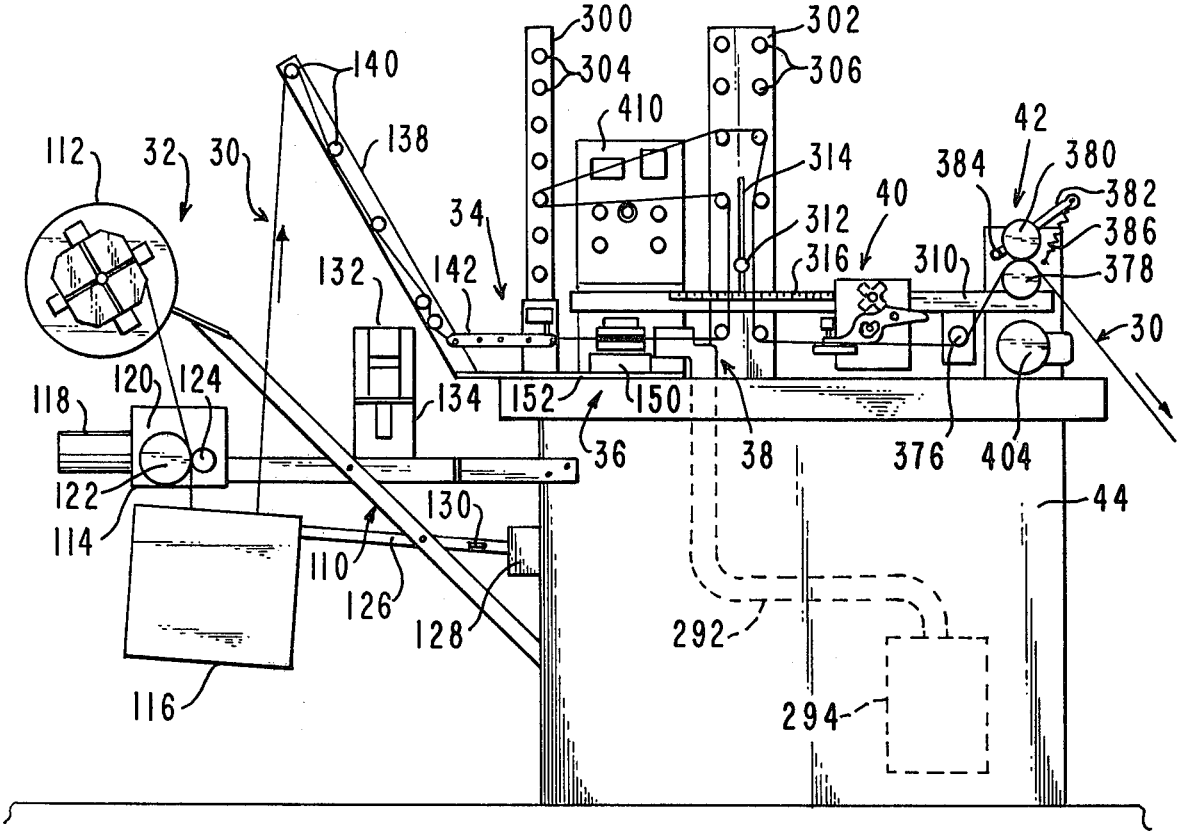
FIG. 1 is a front elevation view of an apparatus for forming a gap in a slide fastener chain in accordance with the invention.
Figure 2:
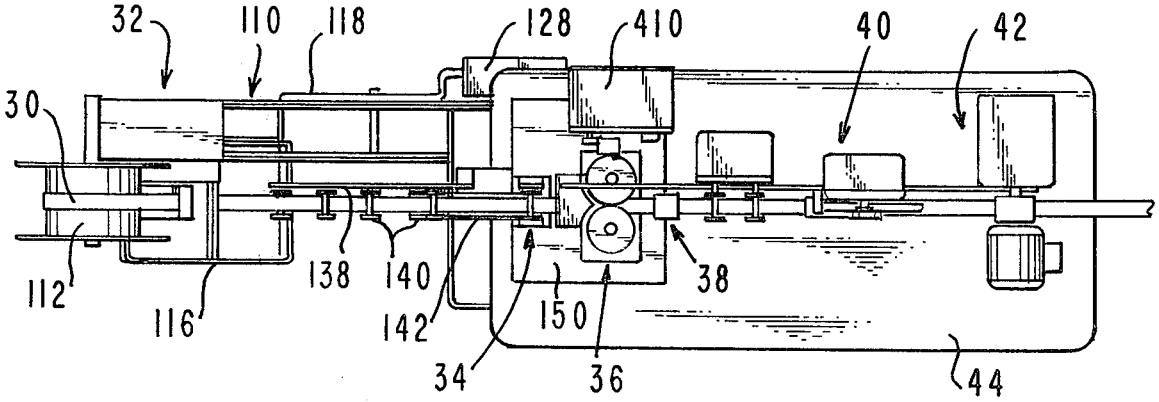
FIG. 2 is a top plan view of the apparatus of FIG. 1.
Figure 3:
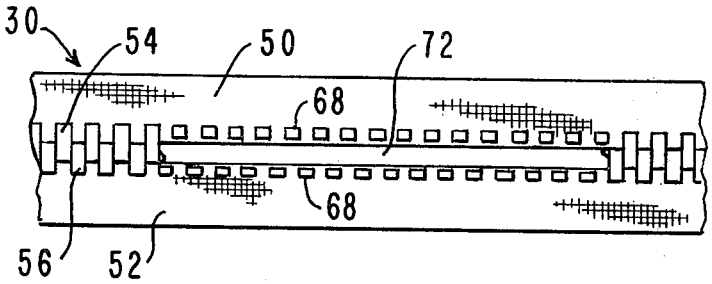
FIG. 3 is a plan view of a broken away section of a slide fastener chain illustrating a gapped section in accordance with the invention.
Figure 4:
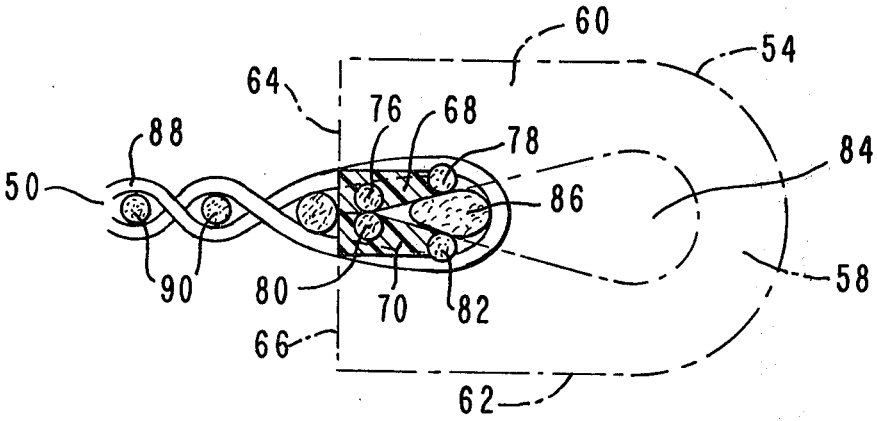
FIG. 4 is a cross section view of a broken-away portion of a stringer of the gapped section of FIG. 3.

As illustrated in FIGS. 1 and 2, one embodiment of an apparatus for gapping a continuous slide fastener chain indicated generally at 30, i.e. removing coupling elements from selectively spaced sections of the slide fastener chain 30, includes a supply station or mechanism indicated generally at 32, an end of reel and splice detecting station or mechanism indicated generally at 34, a leg severing station or mechanism indicated generally at 36, a severed element removing station or mechanism indicated generally at 38, a gap detecting mechanism or station indicated generally at 40, and a pulling station or mechanism indicated generally at 42, all mounted upon a supporting table 44. The slide fastener chain 30, as shown in FIGS. 3 and 4, is a conventional slide fastener chain having planarly arranged supporting tapes 50 and 52 with respective rows of interlocking polymer coupling elements 54 and 56. Each of the coupling elements has a head 58 and legs 60 and 62 extending from the head 58 over opposite sides of inner edge portions of the supporting tapes and terminating in heels 64 and 66 which protrude above and below, respectively, the supporting tapes for being engaged by a slider in a conventional manner. The legs 60 and 62 have respective facing portions 68 and 70 adjacent the heels 64 and 66 which extend within the boundaries of the tape structure and which are securely attached or molded to portions of the tape to secure the fastening elements thereto. Along a selected section of the chain 30, the gapping apparatus of FIGS. 1 and 2 cuts or slices the legs 60 and 62 along planes which are generally coplanar with the upper and lower surfaces, respectively, of the inner edge portions of the tapes to sever the outer portions of the legs 60 and 62 from the inner portions 68 and 70. The severed outer portions of the legs 60 and 62 along with the head portions 58, shown in long and short dashed lines in FIG. 4, are removed to thus form a gap 72 with the remanents 68 and 70 remaining in the inner edge portions of the tapes.

Each of the coupling elements of the particular slide fastener illustrating the present invention has legs 60 and 62 which are welded together at their inner surfaces adjacent their heels 64 and 66. The leg 60 is molded on spaced connecting threads 76 and 78 while the leg 62 is molded on spaced connecting threads 80 and 82; the connecting threads 76 and 80 being embedded in the inner portions of the legs 60 and 62 adjacent to the heels 64 and 66 while the connecting threads 78 and 82 are embedded in the leg portions 60 and 62 spaced from the threads 76 and 80 toward the heads 58. The inner surfaces of the legs 60 and 62 are tangential to the respective connecting threads 76, 78, 80 and 82 and diverge from the weld at the heels 64 and 66 toward points where the legs join the head 58 for forming an opening to receive locking protrusions of heads of the opposing coupling elements. An invested cord 86 is held between the legs 60 and 62 toward the bottom of the heels of the diverging inside surfaces of the legs. The molded coupling elements are held together in spaced relationship by their connecting threads 76, 78, 80 and 82 to form a train of coupling elements. The tapes each includes a weft or filler thread 88 which is interwoven with warp threads 90 in the tape and, at the inner edge of each tape, is looped around the connecting threads 76, 78, 80 and 82 and the invested cord 86 between the coupling elements to secure the train of coupling elements to the edge of the tape. Examples of variations of this type of slide fastener as well as methods and apparatus of manufacture are described in U.S. Pat. Nos. 4,025,277, 4,033,014, 4,084,296, 4,096,225, 4,101,360, 4,137,034, 4,140,157, 4,157,603, 4,158,532, 4,171,556, 4,182,600, and 4,210,985. Although the present invention is preferably employed with slide fasteners having coupling elements molded onto connecting threads woven into an inner edge of a tape, it is believed that the present invention is also applicable to slide fasteners having coupling elements molded directly onto inner edges of tapes.

In the slide fastener chain of FIGS. 3 and 4, the severing planes for the legs 60 and 62 intersect the respective connecting threads 78 and 82 so that, during severing of the legs, the legs break off at the connecting threads 78 and 82 due to the connecting threads 78 and 82 being tangential to the inner surfaces of the legs. The pairs of remanents 68 and 70 are thus spaced from the innermost edges of the tapes and form rigid structures within the inner supporting edge portions of the tapes.

After gapping by the apparatus of FIGS. 1 and 2, the slide fastener chain 30 is formed into slide fasteners such as those illustrated in FIGS. 20 and 22. The slide fastener chain 30 is cut transversely at a selected point in the gap 72 to form individual lengths of slide fastener chain. In the fastener of FIG. 20, conventional top stops 96 and 98 are attached to inner edge portions of gapped sections of the tapes 50 and 52 adjacent to upper ends of the unsevered rows of coupling elements 54 and 56. Conventional pin members 100 and 102 are attached to inner edge portions of the gapped sections of the respective tapes 50 and 52 adjacent to bottom ends of the unsevered coupling elements 54 and 56. A conventional retainer 104 is fastened on the pin member 82, leaving the pin member 80 free to form a separable slide fastener. In the slide fastener of FIG. 23, a conventional bottom stop 106 is fixed across the inner edge portions of both of the tapes 50 and 52 at their gapped sections adjacent to the lower end of the rows of unsevered coupling elements in place of the pin members 100 and 102 and retainer 104 of the fastener of FIG. 20. The remanent portions 68 and 70 of the coupling element legs within the tapes 50 and 52 provide substantial reinforcement of the inner edge portions of the gapped sections of the tapes 50 and 52 for aiding in the support of the stops 96, 98 or 106 as well as the pin members 100 and 102 and the retainer 104. One or more of the stops 96, 08, and 106, the pins 101, and the retainer 104 may be formed of molded polymer; in this instance the remanents 68 and 70 of polymer provide an excellent bond or fusable junction to mount these stops, pins or retainer on the tapes. Furthermore the remanent leg portions 68 and 70 having their outer surfaces generally coplanar with the opposite surfaces of the inner edge portions of the tapes 50 and 52 so as not to interfer with forming stiching lines across the tapes and so as to produce substantially less abrasion to other articles and skin when compared with previous slide fasteners having only the head portions 58 severed from the gaps leaving leg portions protruding substantially from the tapes.

The supply mechanism 32, FIGS. 1 and 2, is substantially similar to prior art supply mechanisms and includes a frame structure indicated generally at 110 supporting a reel 112, a chain dereeling mechanism 114, and a supply container 116. The reel 112 is a conventional reel for supporting a supply of slide fastener chain and is freely rotatable except for a predetermined amount of frictional drag. The dereeling mechanism 114 includes a motor 118 with a suitable gear arrangement 120 for driving a wheel 122. A roller 124 is provided for holding the chain 30 against the wheel 122 for pulling the chain 30 from the reel 112. The container 116 is mounted beneath the dereeler 114 for receiving the chain 30 and is mounted on one end of an arm 126 which is pivotally mounted at midpoint on the framing structure 110 and has a counterweight 128 adjustably secured on the opposite end of the arm 126. A level responsive switch, such as a mercury switch 130, is also mounted on the arm 126. The counter weight 128 is adjusted so that the box 116 is held in a raised position when an insufficient quantity of chain 30 is fed into the box 116 and pivots to a lower position when a desired quantity of chain 30 is dereeled into the box 116.

In an alternative embodiment, another type of prior art supply or dereeler mechanism (not shown) replaces the supply mechanism 32. The alternative mechanism employs a driver wheel and roller similar to the wheel 122 and roller 124 together with conventional means, for example a pivotal arm (not shown), sensing tension or loop length of the slide fastener chain to dereel the chain and prevent excessive tension in the chain at the gapping station.

A conventional hot splice unit 132 is mounted on a bracket 134 on the framing 110. The splice unit 132 is suitable for splicing the trailing end of a slide fastener chain from an exhausted reel to the leading end of a next reel of tape in a conventional manner.

Figure 5:
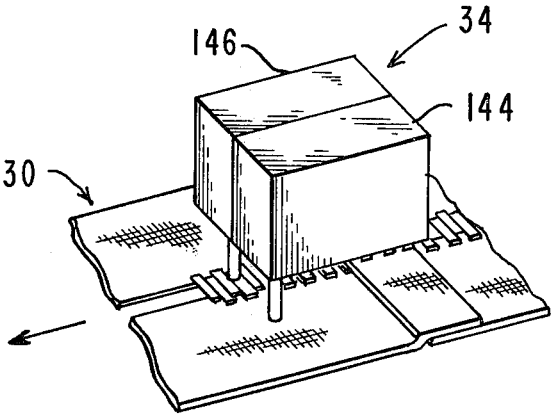
FIG. 5 is a perspective view from the rear upper right corner of run-out and splice detecting sensors in the apparatus of FIG. 1.

An arm 138 is mounted on the left end of the table 44 and extends upwardly into the left. A plurality of rollers 140 are mounted on the arm for receiving the chain 30 and directing the chain to a guide 142 leading to the splice and run-out detecting mechanism 34. As shown in FIG. 5, the mechanism 34 includes a splice detecting switch 144 and a run-out detecting switch 146 mounted over a guide path for the slide fastener chain 30 so as to be operated by a change in thickness of the chain 30 passing beneath the switches. The splice detector switch 144 is selected to be operated when the thickness of the chain 30 increases indicating a splice which may be formed by overlaped ends of the chain together such as by staples (not shown) or other means, may be formed by heat-sealed tape securing chain ends together, etc.. The run-out detecting switch 146 is selected to operate when the thickness of the chain decreases indicating that the chain is absent.

Figure 6:
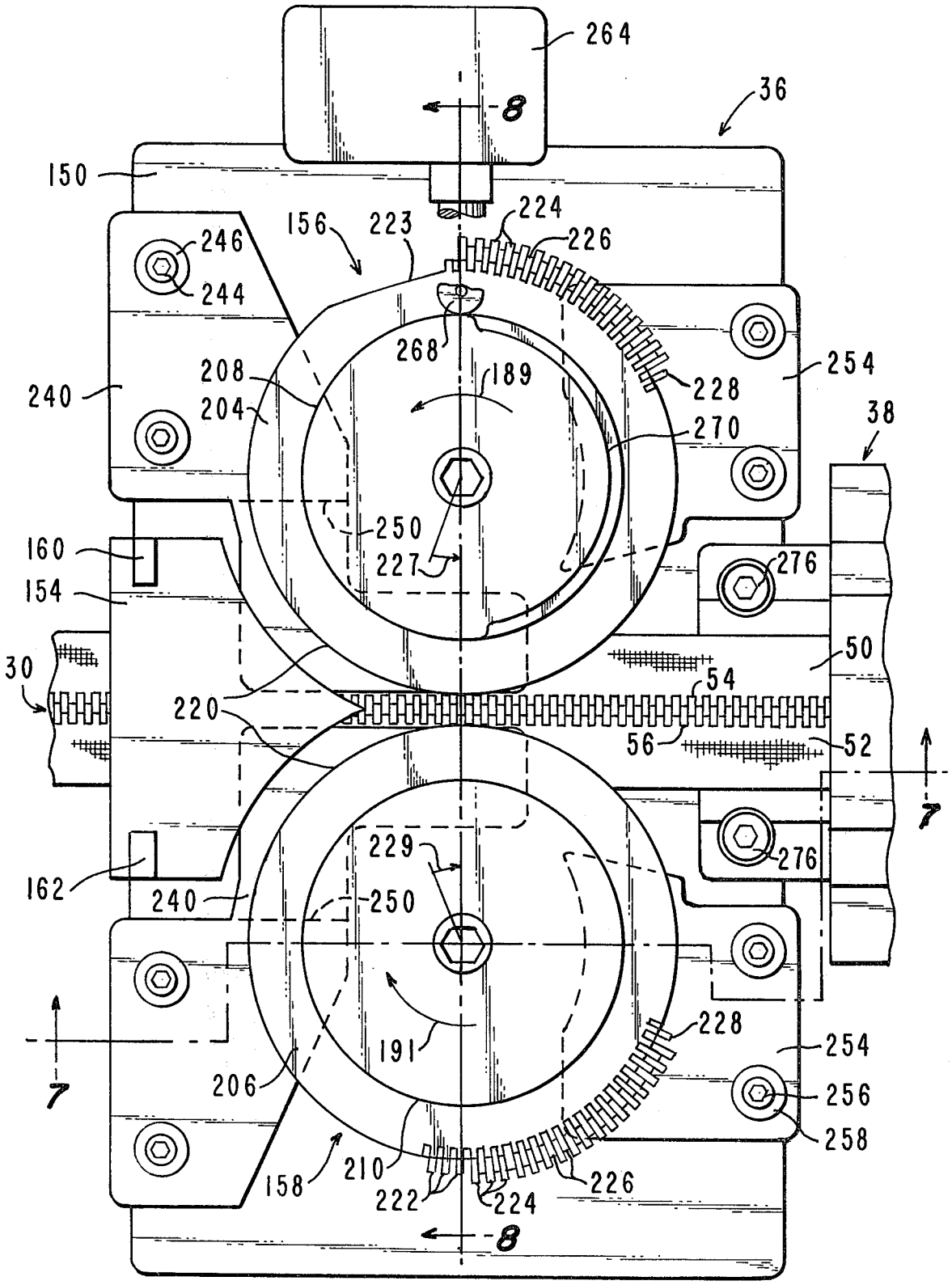
FIG. 6 is a top plan view of a gapping station in the apparatus of FIGS. 1 and 2.
Figure 17:
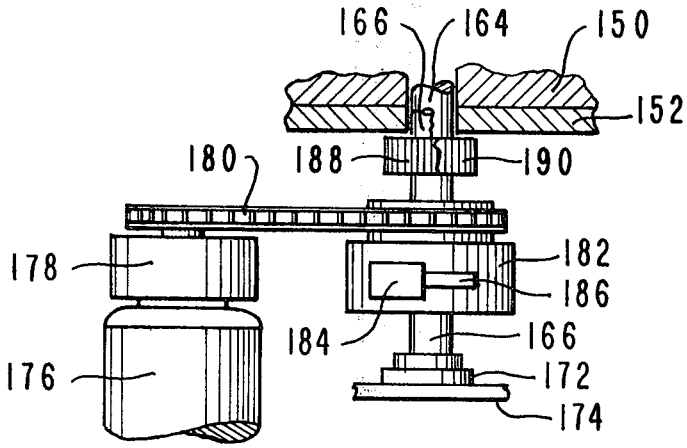
FIG. 17 is a diagramatic view with portions broken away of a drive mechanism for the cutting wheels in the apparatus of FIGS. 1, 2 and 6–8.

The element cutting mechanism 36 is positioned to the right of the run-out and splice detecting mechanism 34 and includes a support block 150 mounted on a plate 152 which is secured to the top of the table 44. As shown in FIG. 6, a guide assembly 154 is mounted on the left edge of the block 150 for directing the slide fastener chain 30 to a pair of cutting wheel assemblies indicated generally at 156 and 158. The guide assembly 154 includes a hinge 160 and a latch 162 so that it may be opened up to permit easy insertion of the chain 30. As shown in FIGS. 7 and 8, the cutting wheel assemblies 156 and 158 are mounted on the upper ends of respective vertical shafts 164 and 166 rotatably supported by bearings 168 and 170 in the blocks 150. As shown in FIG. 17 the shafts 164 and 166 extend downward through the block 150 and the plate 154 and the lower ends of the shafts are suitably supported by bearings on frame members (only the shaft 166 supported by a bearing 172 mounted on a frame member 174 is shown in FIG. 17). A motor 176 is coupled through a speed reducer 178 and a chain drive 180 to the input of a clutch 182 which has its output coupled to the shaft 166. The clutch 182 is a conventional one revolution clutch which includes a solenoid 184 with an operator 186 which, when activated by the solenoid 184, trips the clutch 182 to begin a single revolution of the shaft 166. Identical gears 188 and 190 are mounted on the respective shafts 164 and 166 and mesh with each other for driving the shafts 164 and 166 in opposite directions, as shown by the arrows 189 and 191 in FIG. 6, at the same speed.

Referring back to FIGS. 7 and 8, the element cutting assemblies 156 and 158 include respective collars 192 and 194, lower cutting disks 196 and 198 on top of the collars 192 and 194, spacing washers 200 and 202 on top of the disks 196 and 198, upper cutting disks 204 and 206 on top of the washers 200 and 202, and upper clamping securing caps 208 and 210. The collars 192 and 194 are integrally mounted on the shafts 164 and 166 for supporting the cutting disks 196, 198, 204 and 206 together with the spacing washers 200 and 202. The disks have accurately formed center openings through which the upper ends of the shafts 164 and 166 extend to acurately position the rear cutting disks 196 and 204 relative to the front cutting disks 198 and 206. The caps 208 and 210 have centered bottom recesses 212 and 218 for receiving the upper ends of the shafts 164 and 166 and are secured to these upper shaft ends by bolts 216 and 218. The outer portions of the cups 208 and 210 surrounding the recesses 212 and 214 engage the upper surfaces of the upper disks 204 and 206 and securely clamp the corresponding pairs of disk 106, 204, 198 and 206 their spacing washers 200 and 202 between the cap members 208 and 210 and collars 192 and 194. The washers 200 and 202 are selected to have a thickness for spacing the upper cutting disks 204 and 206 from the lower cutting disk 196 and 198 so that the facing surfaces 230, FIG.

13, of each pair of upper and lower disks are in the desired cutting planes for the coupling elements 54 and 56, i.e. generally coplanar with the respective upper and lower surfaces of the inn edge portions of the tapes and intersecting the connecting threads 78 and 82, FIG. 4. The radius of outer cylindrical surfaces 220 of the cutting disks 196, 198, 204 and 206, and the spacing between the shafts 164 and 166 are selected so as to closely confine the rows of interlocking coupling elements 54 and 56 therebetween, but to permit the interlocking coupling elements to pass freely between the cylindrical surfaces 220. The outer diameter of the cutting disk 196, 198, 204 and 206 is sufficiently greater than the outer diameter of the washers 200 and 202 so that the entire width of the tapes 50 and 52 of the slide fastener chain 34 can be received within the respective spaces formed between the respective pairs of upper and lower cutting disks.

Figure 13:
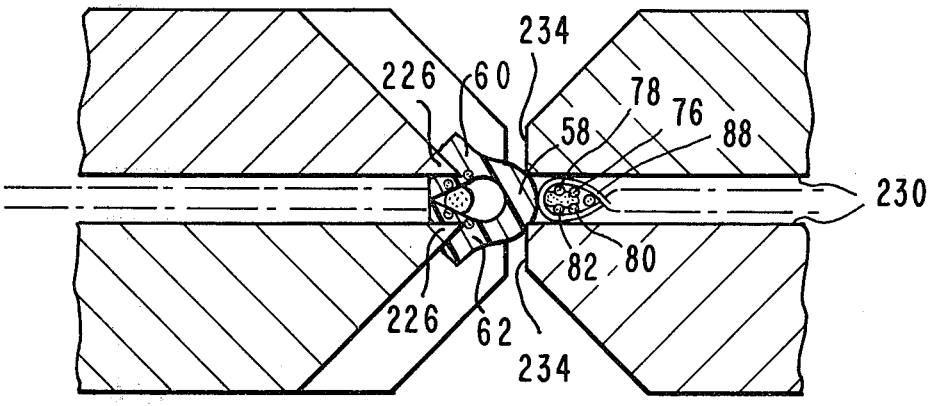
FIG. 13 is a cross section similar to FIG. 12 but at later angle of rotation of the cutting wheels.
Figure 14:
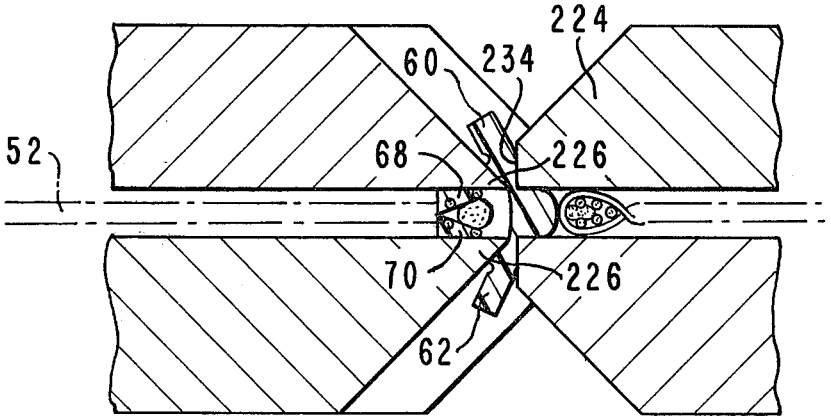
FIG. 14 is a cross section view similar to FIGS. 12 and 13 but at a still a later angle of rotation of the cutting wheels.

A plurality of teeth 224 with interspaced cutting edges 226, and a trailing short tooth 228 all project radially outward from the cylindrical surface 220 of each of the cutting disks 196, 198, 204 and 206 on mating acurate portions of the circumferences of the disks. The teeth 224 and 228 on the rear cutting disks 196 and 204 are designed to engage in the spaces between the legs of adjacent coupling elements 54 while the teeth 224 and 228 on the front cutting disks 198 and 206 are designed to engage in the spaces between the legs of adjacent coupling elements 56. Short positioning teeth 222, projecting from the surface 220 in front of the teeth 224 on the front discs 198 and 206, are designed to initially position into the spaces between coupling elements 56 as the teeth 222 pass through an acurate region defined within the angles 227 and 229 of FIG. 6 so that synchronized movement of the chain 30 is initiated for receiving the longer teeth 224 in the spaces between coupling elements; reliefs 223 on the rear discs 196 and 204 are such that the element chain is permitted to flex to allow the teeth 222 to initially slide when they engage heels of the coupling elements before positioning in the spaces between the elements. The inner surfaces of the teeth 224 are in the planes 230, FIG. 13, for compressing and holding the warp threads 88, the connecting threads 76, 78, 80 and 82 and the invested cord 86, FIG. 12, in the spaces between the coupling elements. The cutting portions 226 between the teeth 224, as shown for the cutting disk 204 in FIGS. 9 and 11, are wedge-like and terminate in a sharp edge formed by the bottom surface 230 of the disk 204 and a sloping surface 232 which slopes downwardly and outwardly from the top past the circumference 220 between the teeth 224; on the lower cutting disks 196 and 198 the sloping surfaces extend upwardly and outwardly between the teeth to form the cutting portions 226. The front edges 234 of the teeth 224 are vertical and extend so as to leave a slight clearance with the opposing cutting edge 226 of the opposite upper or lower cutting disk as shown in FIG. 14 when the corresponding teeth 224 are aligned with a plane defined by the axes of rotations of the cutting disks (see line 8—8 in FIG. 6). The teeth 224 are designed to engage the upper and lower portions of the head of the coupling elements being severed from the slide fastener chain by the opposing cutting portions 226 to insure complete severance of the outer portions of the legs 60 and 62 from the remanents 68 and 70 which are left attached to the tapes 50 and 52 after severance. The short trailing teeth 228 are designed to provide support for the succeeding coupling elements immediately following the last coupling elements being severed from each of the tapes 50 and 52 during the last portion of the severance.

The support tapes 50 and 52 for the slide fastener chain 30 shown in FIGS. 3 and 4 are thicker at the inner edge portion where the weft threads 88 pass around the connecting threads 76, 78, 80 and 82 and invested cord 86 than in the remaining portions of the tape where the weft thread 88 is interwoven with the warp threads 90. In order to maintain centering of the tapes 50 and 52 between the upper and lower cutting disks, front and rear pairs of upper and lower thin guides 240 and 242, FIGS. 6, 7 and 8, are mounted, with spacers 250 between the upper and lower guide of each pair of guides, by bolts 244 and washers 246 on blocks 248 secured on the support block 150 on the entrance side of the cutting station 36. The guides 240 and 242 have portions extending above and below, respectively, the tapes 50 and 52 and extending from the guide assembly 154 through the cutting zone to points at which the tapes 50 and 52 start to emerge from between the cutting disks. The guide members 240 and 242 each have a thickness to about equal to one half of the difference in thickness between the inner edge portion of the tapes 50 and 52 and the outer portions of the tapes. The spacers 250 have a thickness about equal to the thickness of the outer portions of the tapes 50 and 52.

Front and rear stripping mmembers 254 are mounted by bolts 256 and washers 258 on blocks 260 which are secured on the support block 250 on the exit side of the cutting station 36. The stripping members 254 extend between the respective pairs of upper and lower cutting disks for removing any portions of coupling elements which may extend between the cutting disk.

A switch 264 is mounted on a support 266 at the rear of the support block 150 and has an operator with a cam follower 268 which engages the upper portion of the peripheral surface of the rear cap member 208. This upper surface portion forms a cam and has a cut-out 270 extending from about 5° after an initial starting position, as shown in FIGS. 6, to a point about 170° after the initial starting position. The beginning of the raised cam portion at the termination of cut-out 270 is positioned relative to the leading locating teeth 222 for operating the switch 264 after the initial engagement of the teeth with the fastening elements.

Figure 15:
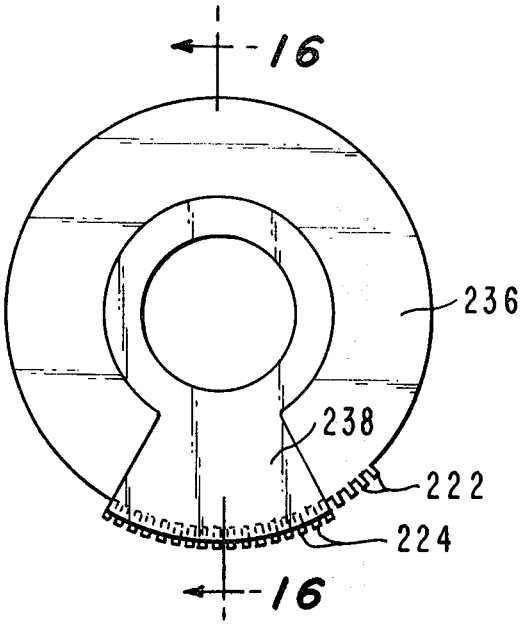
FIG. 15 is a bottom plan view of an alternative construction of a cutting wheel.
Figure 16:
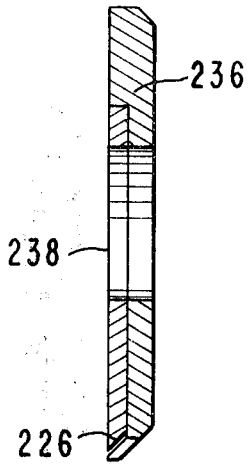
FIG. 16 is a view taken at line 16—16 in FIG. 15.

An alternative construction for the cutting disks is illustrated in FIGS. 15 and 16 and includes an upper member 236 and a lower member 338. The lower member has an annular portion with a pie shaped projection extending outward for forming the cutting edge 226. The upper member 236 has a recess shaped to receive the member 238 and has the teeth 222 and 224 formed thereon. This particular alternative embodiment of FIGS. 15 and 16 was designed by someone other than the present inventors after their invention.

Figure 18:
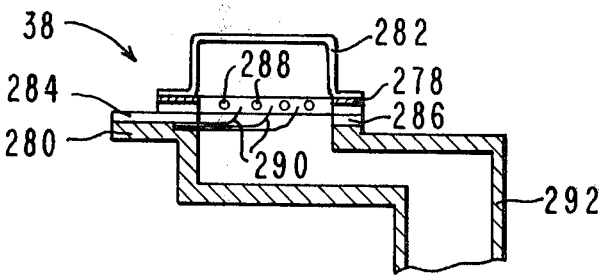
FIG. 18 is a diagramatical section view of a element removing station in the apparatus of FIGS. 1 and 2.

The severed element removing mechanism 38 is similar to a stripping mechanism described in U.S. Pat. No. 4,274,191 and was also designed by someone other than the present inventors for insertion in the described embodiment. This mechanism 38 is mounted by bolts 276, FIG. 6, on the support block 150, and as shown in FIG. 18, includes an upper member 278 and a lower member 280 which conveniently may be hinged and latched together in a conventional manner so that the top member 278 with its transparent cover 282 may be opened to permit easy insertion of the slide fastener chain 30. An input passageway 284 and an exit passageway 286 are formed by corresponding channels cut in the mating surfaces of the upper and lower members 278 and 280. A plurality of horizontal rods 288 are mounted in the upper member 278 and extend horizontally across the upper portion of the path of the slide fastener chain through the cleaner 38. A plurality of spring leaf members 290 are mounted on the lower member 280 and have upturned ends which protrude between the rods 288 for engaging and stripping the severed elements from the gap 72 in the chain 30. The cavity within the lower member 286 is connected by a hose connection 292, see FIG. 1 to a suitable vacuum unit 294 for collecting the severed elements.

Facilities, substantially similar to prior art mechanisms for advancing and measuring desired lengths of of slide fastener chain between gaps, are provided and include spaced vertical standards 300 and 302 (FIG. 1) with respective pluralities of rollers 304 and 306, the gap detecting mechanism 40 (FIG. 19), and the pulling mechanism 42 (FIG. 21).

The spaced vertical standards 300 and 302 are mounted on the top of the table 144 and the rollers 304 and 306 are positioned so that the slide fastener chain 30 may be wound in a number of different configurations in passing from the element removal station 38 to the gap detecting mechanism 40 which is adjustably and slidably mounted on a horizontal bar 310. The adjustability of the position of the mechanism 40 together with the standards 300 and 302 with the rollers 304 and 306 are designed for enabling the selection of a wide variety of desired lengths of slide fastener chain between the gapping station 36 and the gap detecting station 40. A roller 312 adjustably mounted within a vertical slot 314 in the standard 302 may also be utilized to provide for additional adjustability in the length of slide fastener chain between the station 36 and 40. Conveniently a scale 316 is mounted on the bar 310 to aid an operator in selecting a length of slide fastener chain by means of a pointer 318, FIG. 19, mounted on the gap detecting mechanism 40. A hand bolt 320 on the mechanism 40 selectively secures the gapping mechanism to the bar 310.

The gap detecting mechanism 40 as shown in FIG. 19 includes an input guide member 324 with a passageway 326 for directing a slide fastener chain into a channel 328 of a platform 330 which extends beneath one end of a lever 332 pivotally mounted by a bolt 334 secured to the mechanism 40. A first projection 336 extends downward from the left end of the lever 332 and a second projection 338 extends downward from a member 340 adjustably mounted by a screw 342 on the bottom of the left portion of the lever 332 so that the second projection 338 is positioned a selected distance to the right of the first projection 336. The lever 332 and pivot 334 are designed so that the left end of the lever is biased downward by the force of gravity to urge the projections 336 and 338 downward against the interlocking coupling elements 54 and 56 of a slide fastener chain 30 on the platform 330, and when a gap 72 is present on the platform 330, into the gap 72. The spacing between the projections 336 and 338 is set in accordance with the length of the gaps 72 in the slide fastener chain 30. A guide 344 extends over the lever 332 for maintaining alignment of the lever relative to the slide fastener chain. A switch 346 is mounted on the mechanism 40 and has an operator 348 extending downward for engaging an adjustable screw 350 mounted in the left end of the lever 332 for operating the switch 346 when the lever 332 is in a raised position. A shaft 354 with an eccentric camming projection 356, normally extending to the left as shown in FIG. 19, extends beneath a cam projection 358 conveniently extending downward from the top of an opening 359 formed within the lever 332. A gear 360 is mounted on the shaft 354 and has a chain 362 passing therearound. The chain 362 is connected at one end to a spring 364 and its opposite end to an armature 366 of a solenoid 368 mounted within the mechanism 40. The gear 360, chain 362, spring 364 and solenoid 368 are designed to rotate the shaft 354 clockwise, as viewed in FIG. 19, to engage the cam 356 against the cam projection 358 and raise the left end of the lever 332 lifting the projections 336 and 338 above the coupling elements when the solenoid 368 is energized, and to rotate the shaft 354 counterclockwise when the solenoid 368 is deenergized to engage the projections 336 and 338 with the upper surface of the coupling elements. The lever 332 has a handle 370 so that an operator may manually raise the left end of the lever 332 to aid in the insertion of a slide fastener chain.

Referring back to FIG. 1, the chain 30 passes under a roller 376 to a drive wheel 378 and a roller 380 which is mounted on an arm 382 pivoted at 384 on one end and biased by a spring 386 at its opposite end to firmly grip the slide fastener chain 30 against the drive wheel 378. As shown in FIG. 21, the drive wheel 378 is fixed on a shaft 388 coupled to the outputs of a pair of clutches 390 and 392. Inputs of the clutches 390 and 392 are provided from sprockets driven by chains 394 and 396 which are driven by sprockets 398 and 400 mounted on a shaft 402 of a motor 404. The spocket 398 is smaller than the spocket 400 so that when the clutch 390 is energized the drive wheel 384 is driven at a desired slow speed, and when the clutch 392 is energized the drive wheel 384 is driven at a desired fast speed. The slow speed is selected to produce a suitable tension in the chain 30 during cutting of the elements while the fast speed is selected to pull the chain through the gapping apparatus at a desired fast speed between cutting operations.

Figure 23:
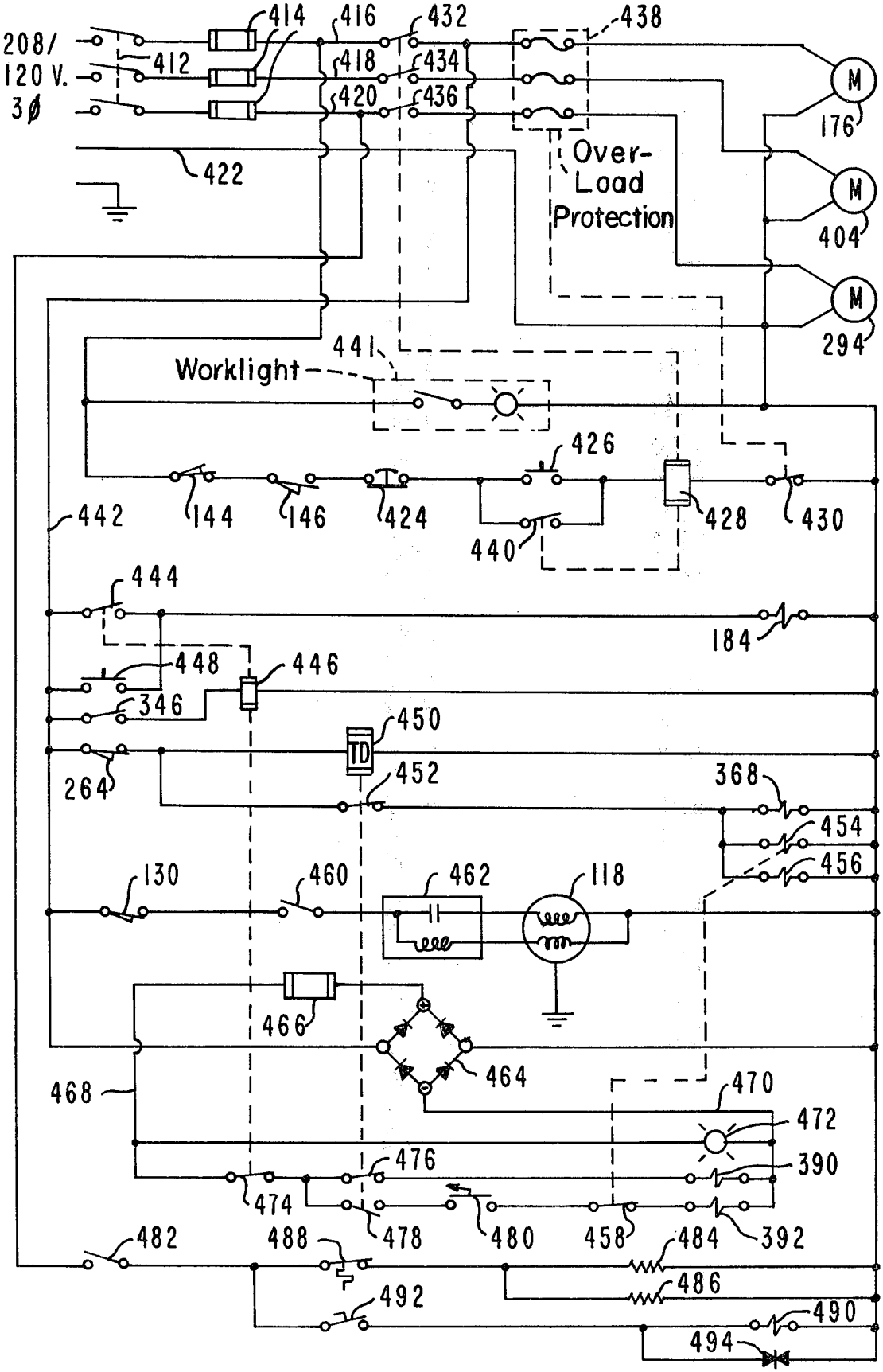
FIG. 23 is a diagram of an electrical circuit for operating the apparatus of FIGS. 1 and 2.

The electrical circuitry for operating the gapping apparatus, illustrated in FIG. 23, is similar to control circuits used in prior art gapping apparatus. Conveniently a box 410, FIGS. 1 and 2, is mounted above the rear of the table 44 and contains various portions of the electrical circuitry as well as including a front cover in which counters and push button switches of the circuitry are mounted. The circuitry is powered by a suitable source such as a Y-connected three-phase power source having its power lines connected by switches 412 and fuses 414 to respective lines 416, 418 and 420 and having its neutral connected to the line 422. The splice detector switch 144 and the runout detector switch 146, both closed when an unspliced section of slide fastener chain is present, are connected in series with normally closed stop push button switch 424, a normally open start push button switch 426, the winding of a start relay 428 and overload protector contacts 430 across the lines 416 and 422. Normally open contacts 432, 434 and 436 of the start relay 428 are connected between the lines 416, 418 and 420 and one inputs of the scoop removal motor 176, the pulling motor 404, and the vacuum unit motor 294, respectively, the other inputs of the motors 176, 404 and 294 being connected to the neutral line 422. The overload protector 438 is also connected in series with the respective one inputs to the motors 176, 404 and 294 for opening contacts 430 in the event of an overload. Normally open contacts 440 of the start relay 428 are connected across the start switch 426 for producing a holding circuit to hold the relay 428 energized after the start switch 426 is released. A worklight 442 may conveniently be connected across the lines 416 and 422.

A line 442 is connected to the side of the start relay contacts 432 opposite to the line 416 for providing power to a portion of the circuitry after the start relay 428 has been energized. A parallel arrangement of normally open contacts 444 of a relay 446 and normally open push button switch 448 is connected in series with the element cutting wheel clutch trigger solenoid 184 across the lines 442 and 422. Gap detecting switch 346, normally held open by a non-gapped section of slide fastener chain in the gapping mechanism, is connected in series with the relay winding 446 across the lines 442 and 422. The cam operated switch 264, normally held closed when the cam follower 268 is not within the cutout 270, is connected in series with the winding of a time delay relay 450 across the lines 442 and 422. Normally closed contacts 452 of the time delay relay 450 are connected in series with the camming switch 264 and a parallel arrangement of the gap detecting retract solenoid 368, a solenoid 454 of a program counter and a solenoid 456 of a total counter. The program counter is presetable to a desired count and includes contacts 458 which are closed when the count reaches 0. The mercury switch 130 is connected in series with a manually operated switch 460, starting circuitry 462 and the dereeler motor 118 across the lines 442 and 422. The lines 442 and 422 are also connected to inputs of a full wave rectifier 464 which has its outputs connected in series with a fuse 466 to DC power lines 468 and 470. A lamp 472 is coupled across the lines 468 and 470 for indicating that the circuit is in a start condition. The winding of the slow pull clutch 390 is connected in series with normally closed contacts 474 of the relay 466 and normally closed contacts 476 of the time delay relay 450 across the lines 468 and 470. The winding of the fast pull clutch 392 is connected in series with the contacts 474, normally open contacts 478 of the time delay relay 450, a toggle switch 480 and the contacts 458 of the program counter 454 across the lines 468 and 470. The toggle switch 480 has a normally open "JOG" position and a closed "RUN" position.

For the hot splice unit, the electrical circuitry includes a manual on-off switch 482 with resistance heaters 484 and 486 connected in parallel with each other and connected in series with a thermostat switch 488 and the switch 482 across the lines 420 and 422. A ram operating solenoid valve 490 is connected in series with a normally open foot switch 492 and the switch 482 across the lines 420 and 422. A protective diode unit 494 is coupled across the solenoid 490.

In operation of the apparatus of FIGS. 1 and 2 for forming gaps 72 in the slide fastener chain 30, a leading length of the slide fastener chain 30 is manually positioned by an operator between the dereeling wheel 122 and roller 124, over the rollers 140, through the splice and run-out detecting mechanism 34, through the guide assembly 154 (FIG. 6), between the guide members 240 and 242 and the cutting wheels 196 198, 204 and 206 in the element cutting station 36, through the element removing mechanism 38, and through the gapping mechanism 40. The power switch 412, FIG. 23, is closed energizing lines 416, 418 and 420. The start push button switch 426 is closed energizing the relay 428 which closes holding contacts 440 as well as contacts 432, 434 and 434 operating the motors 176, 404, and 294 and energizing the line 442. Initially the cam switch 264 will be held closed which results in the energization of the time delay 450 opening the contacts 452 and 476 and closing the contacts 478. The toggle switch 480 will initially be in its open "JOG" position preventing the energization of the fast pull clutch 392.

A first splice in the slide fastener chain is initiated by the operator depressing the push button switch 448 energizing the solenoid 184 which trips the clutch 182, FIG. 17, driving the shafts 164 and 166 to rotate the cutting wheel assemblies 156 and 157, FIG. 6, in opposite directions as shown by the respective arrows 189 and 191. During the first portion of the rotation of the assembly 156, the cam follower 268 enters the cutout 270 opening the switch 264, FIG. 23, which, after a time delay, deenergizes the time delay relay 450 to close the contacts 452, 476 and to open the contacts 478.

Figure 12:
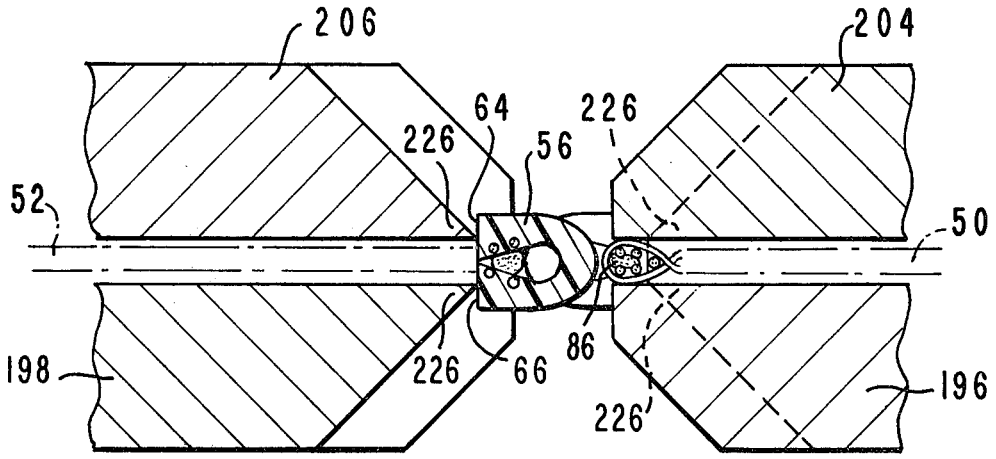
FIG. 12 is a section view illustrating a first step in slicing leg portions in performing a gapping in the apparatus of FIGS. 1 and 2.

When the rotation of the cutting wheel asemblies 156 and 158 brings the short positioning teeth 222 into the angular position represented by the angles 227 and 229, the teeth 222 engage into the spaces between the legs of the coupling elements 54 and 56 and begin to advance the slide fastener chain along with the rotation of the wheel assemblies. After the engagement of the chain with the teeth 222, the cam follower 268 reaches the end of the cutout 270 and closes the switch 264. As shown in FIG. 23, the closing of the switch 264 completes a circuit path through closed contacts 452 of the time delay relay 450 energizing the gap pin retract solenoid 368 as well as the counter solenoids 454 and 456. As the cutting wheel assemblies 156 and 158 continue to rotate, the longer teeth 224 enter the spaces between the legs of the coupling elements 54 and 56 and the cutting edges 226 are brought into engagement with the heels 64 and 66 of the coupling elements 54 and 56. As shown in FIGS. 12, 13, and 14, the rotation of the cutting portions 226 through the angles 227 and 229, FIG. 6, results in severing of the legs 60 and 62 generally along the planes 230 parallel to the tapes and generally coplanar with the opposite surfaces of inner edge portions of the tapes 50 and 52 or intersecting the connecting threads 78 and 82. During this severing, the cutters 226 wedge the outer portions of the legs 60 and 62 outward, and when the cutting edges reaches the connecting threads 78 and 82, this wedging insures complete separation of the severed outer leg portions from the remanents due to the elastic stress in the legs and the wedging action, i.e. any connecting plastic webs of bonds around the connecting threads 78 and 82 are broken. Since the connecting threads 78 and 82 are held inward by the adjacent teeth and surfaces 230, continued movement results in the threads moving inward into the spaces between the cutting disks. Also during the severing, the ends 234 of the teeth 224 engage the upper and lower portions of the heads 58 of the coupling elements to hold the coupling elements during cutting and to cooperate with the opposite cutting portions 226 insuring complete severance of the outer portions of the legs 60 and 62 from the remanents 68 and 70 left attached to the tapes. During the rotation of the teeth 222, 224 and 228 through the angles where they engage the coupling elements, the section of slide fastener chain being gapped is pulled by this rotation to the right between the wheel assemblies 156 and 158. This one revolution clutch 182, FIG. 17, completes its revolution and stops. The coupling elements 54 and 56 which have been severed remain loosely within the gap with their severed leg portions projecting at angles away from the tape.

After the forming of the first gap in the slide fastener chain, a length of the slide fastener chain 30, including the section where the coupling elements have been severed, is pulled through the severed elements removing station 38. During this pulling, the loose elements are engaged on the upper sides by the rods 288, FIG. 18, tending to force the elements downward, and are engaged by the upward protruding ends of the spring leaves 290 on the bottom sides, tending to pull and rotate the severed elements downward. This removes the loose elements from the gap 72. The removed elements fall into in the bottom interior of the removal mechanism 38 from which they are removed by air through the hose connection 292 to the vacuum unit 294, FIG. 1.

Threading of the leading end of the slide fastener chain 30 will be completed through the pulling mechanism 42 with the initial gap just formed being positioned to the left or upstream from the gapping mechanism 40. The length of slide fastener chain between the gap detecting mechanism 40 and the gapping station 36 is selected in accordance with the desired length of ungapped sections of slide fastener chain between successive gaps. For short lengths, the chain 30 passes directly from the element removal station 38 to the gap detecting mechanism 40 which is set along the bar 310 in accordance with the desired lengths. For longer lengths, the chain 30 is wounded around rollers 307 and/or the adjustable roller 312. For even longer lengths the chain can also be passed around the rollers 304 on the standard 300 as shown in FIG. 1.

To begin automatic operation of the gapping apparatus, the switch 480, FIG. 23 is turned to the "RUN" or closed condition which completes a circuit through contacts 474, 478 and 458 energize the clutch 392. As shown in FIG. 21 the energization of the clutch 392 connects the drive chain 396 to the shaft 388 and the pulling wheel 384 to pull the slide fastener chain from left to right through the gapping apparatus of FIG. 1. When the gap previously formed reaches the gap detecting mechanism 40, the projections 336 and 338 on the bottom of the lever 332, FIG. 19, are urged into the gap under the weight of the lever. This movement into the gap rotates the forward end of the lever 332 downward disengaging the adjustable member 350 from the switch operator 384 to close the switch 346. Closing of this switch 346, FIG. 23, results in energization of relay 446 opening contacts 474 which results in deenergization of the clutch 392. The projection 336, FIG. 19, will engage the coupling elements on the left end of the gap 72, FIG. 3, effectively stopping advancement of the slide fastener chain 30. Operation of the relay 446 also closes contacts 444 completing a circuit path to energize the solenoid 184 which initiates another revolution of the element cutting wheel assemblies 156 and 158. This rotation causes the cam follower 268, FIG. 6, to open the switch 264 deenergizing the time delay relay 450, FIG. 23, to close contacts 252 and 476 and open contacts 478. After engagement of the teeth 222 with the coupling elements, the rotation of the cutout 270 passes the cam follower 268 closes the switch 264 to energize the gap projection retracting solenoid 368 as well as the counter solenoids 454 and 456. Energization of the solenoid 368 causes rotation of the shaft 354, FIG. 19, and the eccentric projection 356 to engage the cam 358 and raise the forward end of the lever 332. When the forward end of the lever 332 raises, the adjustable member 350 engages the switch operator 348 causing the switch 346 to open. When the switch 346, FIG. 23, opens, the relay 466 is deenergized resulting in the closing of contacts 474 completing a circuit path through contacts 476 and the slow pull clutch winding 390. The raising of the forward end of the lever 332 raises the projections 336 and 338 from the gap in the chain releasing the chain. As shown in FIG. 21 when the clutch 390 is energized the drive shafts 388 and pulling wheel 384 are connected to the slow speed chain 394 to pull the slide fastener chain through the gap detecting station 40 and element removal station 38. The teeth 222 and 224 will be engaged with the coupling elements 54 and 56 preventing the chain 30 from being freely pulled through the element cutting station 36. Thus a tension is applied in the chain 30 to pull any slack in the chain 30 to the right of the cutting wheel assemblies 156 and 158. After the time delay of the time delay relay 450, the relay 450 opens contacts 452 deenergizing the gap projection retracting solenoid 468 as well as opening contacts 476 and closing contacts 478. The time delay of the relay 450 is generally set to be equal to about the duration of time that the teeth 222, 224 and 228 are in engagement with the coupling elements 54 and 56 to maintain tension in the chain 30 and to prevent the chain from bunching up between the rotating cutting wheel assemblies 156 and 158 and the element removal station 38. The opening of the contacts 476 deenergizes the slow pull clutch 390 and energizes the fast pull clutch 392. Thus the chain 30 is again pulled rapidly through the gapping apparatus until the next gap is detected to begin another operation.

When the count in the program counter 454 reaches 0, the contacts 458 open preventing the energization of the fast pull clutch 392. Thus after the selected number of gaps have been made, the apparatus will stop.

The guides 240 and 242 hold the tapes 50 and 52 centrally between the respective pairs of cutting wheels 196, 204, 198 and 206. This ensures that the cutting edges 226 are coplanar with the surfaces of the inner tape edge portions or aligned with the connecting threads 78 and 82. For different types of slide fasteners the inner edge portions may be the same thickness as the outer portions of the tapes, and the guides 240 and 242 may be eliminated since the tapes will be centrally positioned by the inside surfaces of the upper and lower cutting disks.

The employment of rotating cutting wheels for cutting the coupling elements produces a substantially improved and efficient cutting action for the elements. Cutting by rotating cutting wheels occurs sequentially thus requiring less force since only a few of the elements at a time are within the angles 227 and 229 where the severing is being performed. A single rotation of the cutting wheels results in positioning of the elements relative to the radial cutters 226, operation of the cutters, and disengagement of the cutters 226 from elements. Because movement of the chain 30 is continuous during the cutting and the advancement of the section of chain, a relatively large number of gaps can be performed in a short time period; delays such as start-up delays and delays for cutter retraction are eliminated. Further the rotating cutting wheel assemblies are substantially less expensive to manufacture and maintain relative to apparatus employing different types of cutters operated by more complex mechanisms.

Since many modifications, variations and changes in detail may be made to the above described embodiments, it is intended that all matter described in the foregoing description or shown in the accompanying drawings be interpreted as illustrative and not in a limiting sense.

What is claimed is:

1. A method of forming gaps in rows of coupling elements secured on respective inner edge portions of a pair of coplanar supporting tapes in a slide fastener chain, comprising the steps of positioning a section of the slide fastener chain relative to first and second spaced cutting disks such that coupling elements at one end of the section of slide fastener chain are positioned between peripheral portions of the cutting disks, rotating the cutting disks in opposite directions so as to engage cutting sections protruding radially from the periphery of the disks with coupling elements to sever portions of the engaged coupling elements and to pull the section of slide fastener chain between the disks, and removing the severed portions of coupling elements from the slide fastener chain to form a gap in the slide fastener chain.

2. A method of forming gaps in rows of molded coupling elements secured on respective inner edge portions of a pair of coplanar supporting tapes in a slide fastener chain, comprising the steps of positioning a section of the slide fastener chain relative to pairs of upper and lower cutting disks such that the tapes of the slide fastener chain are centrally confined between the upper and lower cutting disks of the respective pairs of cutting disks and such that upper and lower leg portions of the coupling elements protruding above and below the inner edge portions of the tapes are positioned between peripheral portions of the upper cutting disks and the lower cutting disks, respectively, rotating the pairs of cutting disks in opposite directions so as to engage cutting sections protruding radially from the periphery of the disks with the leg portions to sever the leg portions from remanents remaining attached to the tapes, and removing the severed outer leg portions and head portions of the severed coupling elements from the slide fastener chain to form a gap in the coupling elements on the slide fastener chain.

3. A method as claimed in claim 1 or 2 which includes engaging teeth projecting radially from the cutting disk between legs of fastening elements during the rotation of the disk to move the fastening elements being severed between the rotating disks.

4. A method as claimed in claim 3 wherein the severing is performed by wedge-like cutting portions formed between the engaging teeth.

5. A method of forming a gap in a slide fastener chain wherein the chain includes a pair of rows of molded interlocking coupling element secured to inner edges of support tapes, each coupling element having a pair of legs with inner surfaces of each pair of legs diverging apart from heels of the legs toward a head of each coupling element, each leg being molded on a pair of spaced connecting threads which are tangential to the inner surface of each leg wherein a first connecting thread of each pair of connecting threads is adjacent the respective heel and the second of each pair of connecting threads is spaced from the first connecting thread toward the corresponding head, the method comprising the steps of advancing cutting means along a pair of severing planes which are parallel to the tapes and which intersect the second interconnecting threads on opposite sides of the tapes, said advancing including engaging the cutting means with heels of the tapes and severing outer portions of the legs from remanents left attached to the first connecting threads, and removing the severed outer leg portions and the corresponding heads from the slide fastener chain to form a gap in the chain.

6. A method as claimed in claim 5 wherein the advancing includes advancing wedge-like cutting means having outer surfaces inclined outwardly from the severing planes to wedge the outer portions of the legs outwardly during advancement and to separate the severed outer leg portions from the second connecting threads.

7. A method as claimed in claim 6 including holding the connecting threads between the severing planes at points on opposite sides of each of the selected coupling elements to aid in separation of the outer severed portions from the second connecting threads.

8. A method as claimed in claim 7 wherein the holding includes engaging teeth into spaces between coupling elements.

9. A method as claimed in claim 8 wherein both the advancing and the holding are performed by rotating cutting disks with radially extending teeth and radially extending cutting wedges between the teeth.

10. A method as claimed in claim 1, 2 or 5 including freely pulling the slide fastener chain with the tapes disposed between the upper and lower cutting disks and with the coupling elements disposed between the peripheral portions of the pairs of cutting disks to advance the chain to a next position where a gap is to be formed.

* * * * *